US011488818B2

(12) United States Patent
Lehmann

(10) Patent No.: US 11,488,818 B2
(45) Date of Patent: Nov. 1, 2022

(54) DYNAMIC ION FILTER FOR REDUCING HIGHLY ABUNDANT IONS

(71) Applicant: Analytik Jena AG, Jena (DE)

(72) Inventor: Roland Lehmann, Jena (DE)

(73) Assignee: Analytik Jena AG, Jena (DE)

( * ) Notice: Subject to any disclaimer, the term of this patent is extended or adjusted under 35 U.S.C. 154(b) by 0 days.

(21) Appl. No.: 17/258,049

(22) PCT Filed: Jun. 13, 2019

(86) PCT No.: PCT/EP2019/065426

§ 371 (c)(1),
(2) Date: Jan. 5, 2021

(87) PCT Pub. No.: WO2020/007580

PCT Pub. Date: Jan. 9, 2020

(65) Prior Publication Data

US 2021/0287895 A1 Sep. 16, 2021

(30) Foreign Application Priority Data

Jul. 5, 2018 (DE) ..... 10 2018 116 305.3

(51) Int. Cl.
*H01J 49/40* (2006.01)
*H01J 49/06* (2006.01)
(Continued)

(52) U.S. Cl.
CPC ..... *H01J 49/401* (2013.01); *H01J 29/84* (2013.01); *H01J 49/061* (2013.01); *H01J 49/421* (2013.01); *H01J 49/425* (2013.01)

(58) Field of Classification Search
CPC ..... H01J 49/401; H01J 49/061; H01J 49/40; H01J 49/421; H01J 49/425; H01J 29/84
(Continued)

(56) References Cited

U.S. PATENT DOCUMENTS 6,534,764 B1 3/2003 Verentchikov et al.
6,614,021 B1 9/2003 Kalinitchenko
(Continued)

FOREIGN PATENT DOCUMENTS

DE 10150559 A1 5/2003
DE 102004055279 A1 7/2005
(Continued)

OTHER PUBLICATIONS

Meier, Florian, Geyer, Philipp E., Winter, Sebastian Virreira, Cox, Juergen and Mann, Matthias, BoxCar acquisition method enables signle-shot proteomics at a depth of 10,000 proteins in 100 minutes, Nature Methods, Article, https://doi.org/10.1038/s41592-018-0003-5, Nov. 2017, 14 pp.

*Primary Examiner* — Kiet T Nguyen
(74) *Attorney, Agent, or Firm* — Christopher R. Powers; Endress+Hauser (USA) Holding Inc.

(57) ABSTRACT

The present disclosure relates to a device for filtering at least one selected ion from an ion beam includes a unit for creating an electric field for accelerating the ions of the ion beam along a flight path of predefinable length, and a controllable ion optical system, which delimits the flight path in one direction, and which is used to deflect the selected ion from a flight path of the ion beam. The device is further designed to control the ion optical system subject to a flight time of the selected ion along the flight path. The present disclosure also relates to a mass spectrometer having a device according to the present disclosure, and to a method for filtering at least one selected ion from an ion beam.

12 Claims, 5 Drawing Sheets

(51) Int. Cl.
*H01J 29/84* (2006.01)
*H01J 49/42* (2006.01)

(58) Field of Classification Search
USPC ..... 250/287
See application file for complete search history.

(56) References Cited

U.S. PATENT DOCUMENTS

| | | | | |
|---|---|---|---|---|
| 9,048,078 | B2 | 6/2015 | Kalinitchenko | |
| 2008/0230688 | A1 | 9/2008 | Bowdler et al. | |
| 2010/0193681 | A1* | 8/2010 | Vestal | H01J 3/14 250/281 |
| 2012/0168618 | A1 | 7/2012 | Vestal | |
| 2013/0119249 | A1* | 5/2013 | Niehuis | H01J 49/061 250/282 |
| 2014/0346340 | A1* | 11/2014 | Niehuis | H01J 49/0031 250/282 |
| 2017/0236700 | A1* | 8/2017 | Kenny | H01J 49/0031 250/282 |

FOREIGN PATENT DOCUMENTS

| | | | |
|---|---|---|---|
| DE | 102007045361 | A1 | 4/2009 |
| DE | 102010032823 | A1 | 2/2012 |
| JP | 2007335368 | A | 12/2007 |

* cited by examiner

DYNAMIC ION FILTER FOR REDUCING HIGHLY ABUNDANT IONS

CROSS-REFERENCE TO RELATED APPLICATIONS

The present application is related to and claims the priority benefit of German Patent Application No. 10 2018 116 305.3, filed on Jul. 5, 2018, and International Patent Application No. PCT/EP2019/065426, filed on Jun. 13, 2019, the entire contents of which are incorporated herein by reference.

TECHNICAL FIELD

The present disclosure relates to a device for filtering ions with at least one selected ion mass from an ion beam, to a mass spectrometer having such a device and to a method for filtering ions with at least one selected ion mass from an ion beam.

BACKGROUND

The analysis and/or characterization of samples by means of mass spectrometry is nowadays widely used in a wide variety of fields, such as in chemistry, in particular medicinal chemistry. Numerous different types of mass spectrometers have become known from the prior art, such as sector, quadrupole or time-of-flight mass spectrometers or also mass spectrometers with inductively coupled plasma. The modes of operation of the different mass spectrometers have been described in numerous publications and are therefore not explained in detail here.

In a mass spectrometer, the respective molecules or atoms to be examined are first converted into the gas phase and ionized. Various methods known per se from the prior art are available for ionization, such as impact ionization, electron impact ionization, chemical ionization, photoionization, field ionization, the so-called fast atom bombardment, the matrix-assisted laser desorption ionization or electrospray ionization.

After ionization, the ions pass through an analyzer, also referred to as a mass selector, in which they are separated according to their mass-to-charge ratio m/z. A multiplicity of different variants of the analyzers is also available. The different modes of operation are based, for example, on the application of static or dynamic electric and/or magnetic fields or on different flight times of different ions.

Lastly, the ions separated by means of the analyzer are detected in a detector. In this respect, photomultipliers, secondary electron multipliers, Faraday catchers, Daly detectors, microchannel plates or channeltrons have become known from the prior art, for example.

Particular requirements for the respectively used mass spectrometer result from the analysis of complex samples, e.g., proteomes of body fluids, in particular serum samples. Such samples have a very large dynamic range in terms of the concentration of the ions, which is frequently not completely detectable by means of conventional mass spectrometry. Often times, the molecules of interest, e.g., cytokines, chemokines, or tumor markers, are present in such low concentrations compared to other molecules that they are not detected at all. Particularly in the case of clinical samples, this can lead to only a fraction of the substances, as can be identified in more homogeneous cell supernatants, being detectable. In addition, the respective mass spectrometric analyses may have low reproducibility, since the redetection rate of the low-concentration substances is often very low.

It is thus desirable to increase the detection possibilities of low-concentration substances in complex samples.

So-called tandem mass spectrometry, in which specific ions are excited in a targeted manner for fragmentation, is known in this connection. The examination of the fragmentation patterns allows conclusions to be drawn about the starting products. In this regard, a distinction is made between spatial tandem mass spectrometry, in which at least two analyzers are coupled one after the other, and temporal tandem mass spectrometry, in which ion traps are used. First, a scan (MS1) is carried out over the entire mass range. The ions are then fragmented in an impact chamber, e.g., using an impact gas. With respect to the decomposition products, scans (MS2) are then likewise carried out but over reduced mass ranges. The term "scan" is understood here to mean the recording of a mass spectrum over a specific mass range.

A method for analyzing complex samples with improved sensitivity with respect to low-concentration substances is known from the article "BoxCar acquisition method enables single-shot proteomics at a depth of 10,000 proteins in 100 minutes" by Floridan Meier et al., published in Nature Methods (2018) (doi:10.1038/s41592-018-0003-5). First, a scan is performed over the entire available mass range. The available mass range is then divided into a plurality of subranges and the respective ions with masses within the respective subrange are analyzed successively and separately from one another. In addition, the number of ions to be analyzed in a specific subrange can be limited.

Ranges with high intensities in relation to the total filling can thus be limited. The achievable sensitivity of the mass spectrometer can be clearly increased by the method described, in particular with regard to low-concentration ions in complex samples. However, it may be disadvantageous that a compromise must always be found between the duration of a complete cycle and the achievable sensitivity, since the time for a complete pass increases significantly with the number of subranges. At the same time, the quantity of collected ions from the entire ion beam decreases.

SUMMARY

The object of the invention is to further increase the detection possibilities of low-concentration substances in complex samples.

This object is achieved by the device, the mass spectrometer and the method according to the present disclosure.

BRIEF DESCRIPTION OF THE DRAWINGS

The device according to the invention is a device for filtering at least one selected ion from an ion beam. The device comprises:

- a unit for creating an electric field for accelerating the ions of the ion beam along a flight path of predefinable length; and
- a controllable ion optical system which delimits the flight path in one direction and which deflects selected ions from the flight path of the ion beam.

Figure 1:
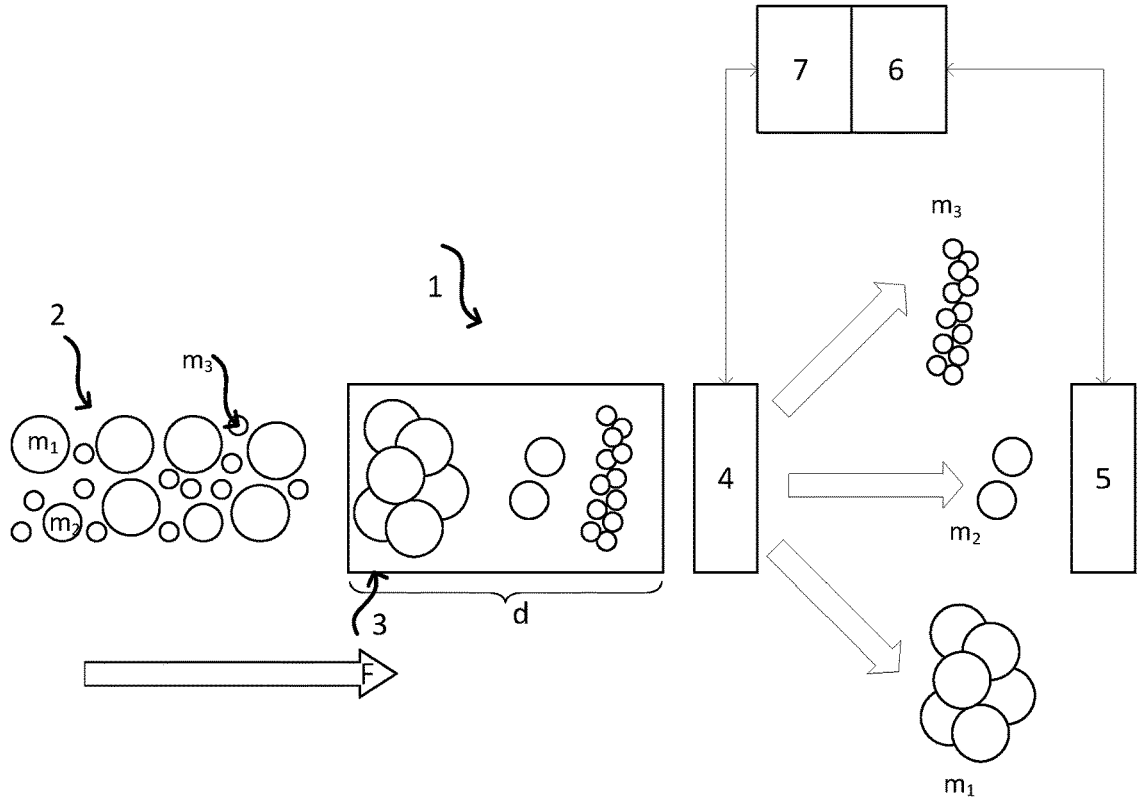

The device is furthermore designed to control the ion optical system subject to a flight time of the selected ion along the flight path.

In the unit for creating an electric field for accelerating the ions of the ion beam, the principle of time-of-flight (TOF) measurement is used. The different ions contained in the ion beam are thus separated on the basis of different flight times.

The ion optical system then serves to prevent specific ions from reaching the detector, or, optionally, from reaching an ion trap arranged upstream of the detector, where they are collected before their detection by means of the detector. For example, the ions can be deflected by electric and/or magnetic fields, in particular switchable electric and/or magnetic fields. For this purpose, the ion optical system is controlled, for example, in a time-dependent manner, in particular dynamically. The ion optical system is arranged in particular in an end region of the flight path. The ion beam may be a focused ion beam, wherein the ion optical system is arranged at the location with the optimum focal point.

The ion optical system is switched on during at least one time interval in which the ions with the selected ion mass pass through the ion optical system. The ion optical system then deflects such ions from their flight path such that they are no longer contained in the ion beam and are no longer collected and/or detected.

According to the invention, it is on the one hand conceivable to deflect individual selected ions with individual selected ion masses, charges and/or mass-to-charge ratios from the ion beam. However, it is also conceivable to remove ions within selected ranges for the ion masses, charges and/or mass-to-charge ratios from the ion beam.

The selected ions are in particular ions of highly concentrated substances, in particular in complex samples, which are however not of primary interest for the respective mass analysis.

Mass spectrometers known from the prior art frequently have only a limited capacity for recording and measuring ions. There is thus a specific saturation of the detector or of the optionally present ion trap. On the other hand, the identification of a specific ion requires a minimum number of such ion in the ion beam. The consequence of such two boundary conditions is that many low-concentration substances are below the detection limit or else the sensitivity limit of the mass spectrometer when analyzed by mass spectrometry and thus cannot be identified.

The present invention solves this problem by selectively deflecting specific highly concentrated substances from the ion beam in a targeted manner. As a result, the low-concentration substances are present in a greater number after passing through the ion optical system and can accordingly be identified by means of the mass spectrometer. This constitutes a great metrological improvement in the field of mass spectrometry, in particular in the field of analysis and medical diagnostics.

In one embodiment, the device according to the invention comprises a detector unit, which is designed to detect and/or determine the masses, charges, mass-to-charge ratios and/or intensities of the ions contained in the ion beam.

The detector unit serves at least to record mass spectra of the ion beam. In some embodiments of the present invention, the detector unit may also be designed to further process the recorded mass spectra. However, this can also take place by a separate computing unit.

In another embodiment, the device according to the invention accordingly comprises a computing unit, which is designed to determine the flight times, masses, charges, mass-to-charge ratios and/or intensities of the ions contained in the ion beam. The intensity is a measure for the number of specific ions. In addition to the intensities or instead of the intensities, the number of different ions contained in the ion beam can also be determined.

In other embodiments, the detector unit may also be part of a mass spectrometer, in particular an existing mass spectrometer, with which the device according to the invention can be used, or whose integral component the device is. The computing unit may also be part of the detector unit, or may also be part of a mass spectrometer with which the device according to the invention can be used, or whose integral component the device is.

In yet another embodiment, the device according to the invention comprises a control unit, which is designed to control the ion optical system subject to a flight time of the selected ion along the flight path. For this purpose, the control unit can interact directly or indirectly with the computing unit and/or detector unit and/or have, for example, another separate computing unit. The selected ion can be used to generate a filter pattern on the basis of which the ion optical system can be controlled.

The selected ion is preferably determined on the basis of at least one predefinable criterion. For example, the ions to be deflected in each case can be selected on the basis of the respective intensities, or on the basis of their number, or on the basis of their masses and/or charges, in particular on the basis of their mass-to-charge ratio. It is also conceivable to specify a list (e.g., an exclusion list) with ions that are not to be taken into account for the respective analysis. It is also conceivable for the ions to be selected on the basis of a complete spectrum of the ion beam.

If a computing unit and a control unit are present, it is conceivable, for example, to implement the computing unit and control unit in a single electronic unit. However, it is also conceivable for the computing unit to be part of a first electronic unit and for the control unit to be part of a second electronic unit. Separate electronic units for the detector unit and the control unit are used in particular when the detector unit is part of a mass spectrometer.

A particular embodiment of the device includes that the ion optical system comprises at least one Bradbury-Nielson gate. A so-called Bradbury-Nielson gate comprises a fine-meshed arrangement of wires or slats, by means of which a multiplicity of parallel electromagnetic fields can be generated for deflecting ions from an ion beam. Such electromagnetic fields advantageously deflect the ions from their respective flight path only in a small region but highly efficiently. The Bradbury-Nielson gate is accordingly characterized by a very small spatial field of influence and thus by a high spatial resolution. Moreover, it is a very fast and precisely switchable, or controllable, ion optical system.

In another embodiment, the device includes an ion trap for accumulating or depleting at least one predefinable ion or a plurality of predefinable ions within at least one predefinable range. The range is in particular a predefinable range for the masses, charges or mass-to-charge ratios of the predefinable ions. This measure allows the sensitivity of the mass spectrometer to be increased even further, which can be advantageous especially in the case of ions of particularly low concentration. The ion trap is, e.g., arranged downstream of the ion optical system and upstream of the detector.

It is advantageous if the ion trap is an orbitrap or a C-trap.

In one embodiment, the device comprises an ion optical system which serves to direct the ion beam at least at a predefinable point in time in such a way that the ion beam passes through the device. However, by means of the ion optical system, the ion beam can, on the other hand, also be supplied directly to the detector or the optionally present ion trap. In this case, a mass spectrum can, for example, be recorded over the entire available mass range without being affected by filtering according to the invention. However, at at least one predefinable point in time or during predefinable time intervals, the ion beam can also be directed by appropriate control of the ion optical system in such a way that it passes through the device, and the at least one selected ion is accordingly deflected before the remaining ion beam is supplied to the detector. The ion optical system, e.g., comprises at least one ion mirror as described, for example, in the documents U.S. Pat. No. 6,614,021B1 or U.S. Pat. No. 9,048,078B2.

The object underlying the present invention is furthermore achieved by a mass spectrometer having a device according to the invention according to at least one of the described embodiments. For example, the device can be implemented in a fixed manner in an existing mass spectrometer.

It is advantageous if the mass spectrometer has means for generating an ion beam, in particular a focused ion beam, and wherein the device is arranged between the means for generating the ion beam and the detector. For this embodiment, the device is an integral component of the mass spectrometer or is permanently installed in the respective mass spectrometer. Depending on the mass spectrometer used, the detector and/or the computing unit can also be parts of the mass spectrometer. In the case of a time-of-flight mass spectrometer, the unit for creating an electric field for accelerating the ions of the ion beam along a flight path of predefinable length may also be part of the mass spectrometer. For implementing the device according to the invention, the components that are already part of the mass spectrometer may not need to be doubled. but can be used for filtering according to the invention and for mass spectrometric analysis.

The object underlying the invention is likewise achieved by a method for filtering at least one selected ion from an ion beam, in particular by means of a device according to the invention, comprising the following method steps:

accelerating the ions of the ion beam along a flight path of predefinable length; and deflecting the selected ion from a flight path of the ion beam subject to a flight time of the selected ion along the flight path.

The flight times of the ions can be determined, for example, on the basis of the masses and/or mass-to-charge ratios of the ions contained in the ion beam. These can be determined, for example, together with the charges and/or intensities of the ions contained in the ion beam, e.g., on the basis of at least one mass spectrum of the sample to be examined in each case. The deflection of the selected ion from a flight path of the ion beam subject to a flight time of the selected ion along the flight path can, for example, take place by means of a controllable ion optical system.

In one embodiment of the method, the selected ion is determined on the basis of at least one mass spectrum of the ion beam and/or on the basis of the masses, charges, mass-to-charge ratios and/or intensities of the ions contained in the ion beam. The respective mass spectrum is in particular a scan over the entire available mass range, which is established, for example, once in advance or at predefinable time intervals during operation of the device. However, the selected ion can also be determined on the basis of at least one mass spectrum of an ion beam already filtered at least once.

Instead of a spectrum or in addition to a spectrum, a list of selected ions can also be specified, e.g., when it is known which ions are to be filtered. Such a list may be specified once or generated dynamically at predefinable time intervals during operation of the device. Alternatively, other criteria can also be used to determine the selected ions, in particular those relating to the mass, charge, mass-to-charge ratio, retention time, intensity or a variable derived from one or more of such variables.

In a certain embodiment of the method according to the invention, at least one ion whose intensity or number exceeds a predefinable limit value is selected. Ions from a specific predefinable concentration of the respective substances in the respective sample are thus selected and deflected. Such a selection of the ion to be filtered in each case can advantageously take place in an at least partially automated manner.

One embodiment of the method includes accumulating or depleting at least one predefinable ion or predefinable ions within a predefinable range. The accumulated or depleted ions can subsequently be analyzed by mass spectrometry. Advantageously, the selected ions which are filtered or deflected are not accumulated or depleted.

In this regard, it is advantageous if an accumulation factor or a depletion factor is determined. Accumulation or depletion takes place in an ion trap of known capacity. The ion input current is also known. If the known quantity of applied filtering is additionally determined on the basis of a comparison of recorded mass spectra before and after a filtering is carried out, the quantity of ions reaching the ion trap can be determined and correspondingly also defined in advance.

It is thus advantageous if the at least one predefinable ion, or the predefinable ions within the predefinable range, is/are accumulated or depleted with a predefinable accumulation factor or a predefinable depletion factor. By accumulating or depleting with a predefinable accumulation factor or depletion factor, the proportion by which the respective ion in the ion beam is to be accumulated or depleted can advantageously be defined for the respective ion.

In summary, the present invention advantageously makes it possible to precisely and selectively deflect at least one selected ion from an ion beam, and thus to filter it. However, a plurality of ions can also be filtered in parallel, e.g., on the basis of their masses, charges, mass-to-charge ratios and/or intensities or based on selected ranges for such variables.

In this way, the sensitivity of a mass spectrometer can be significantly increased with regard to low-dose substances. In addition to the analysis of complex samples, the present invention can also be used in connection with so-called molecule sorting, e.g., in order to filter specific ions from a mixture. In addition, another possible field of application of the present invention is in the field of so-called data-independent acquisition (DIA) or also in so-called all-ion fragmentation. In this case, it is possible to sequentially analyze not only specific mass ranges. Rather, the present invention allows molecular patterns and/or molecular classes to be removed or selected and/or multiplied from the entire mass range, in particular by specially adapted filter patterns for filtering the respective ions. For example, a selection can be made with regard to the charge and/or intensity of the ions.

It is pointed out that the embodiments described in connection with the device according to the invention can also be applied mutatis mutandis to the mass spectrometer according to the invention and/or to the method according to the invention and vice versa.

Figure 2:
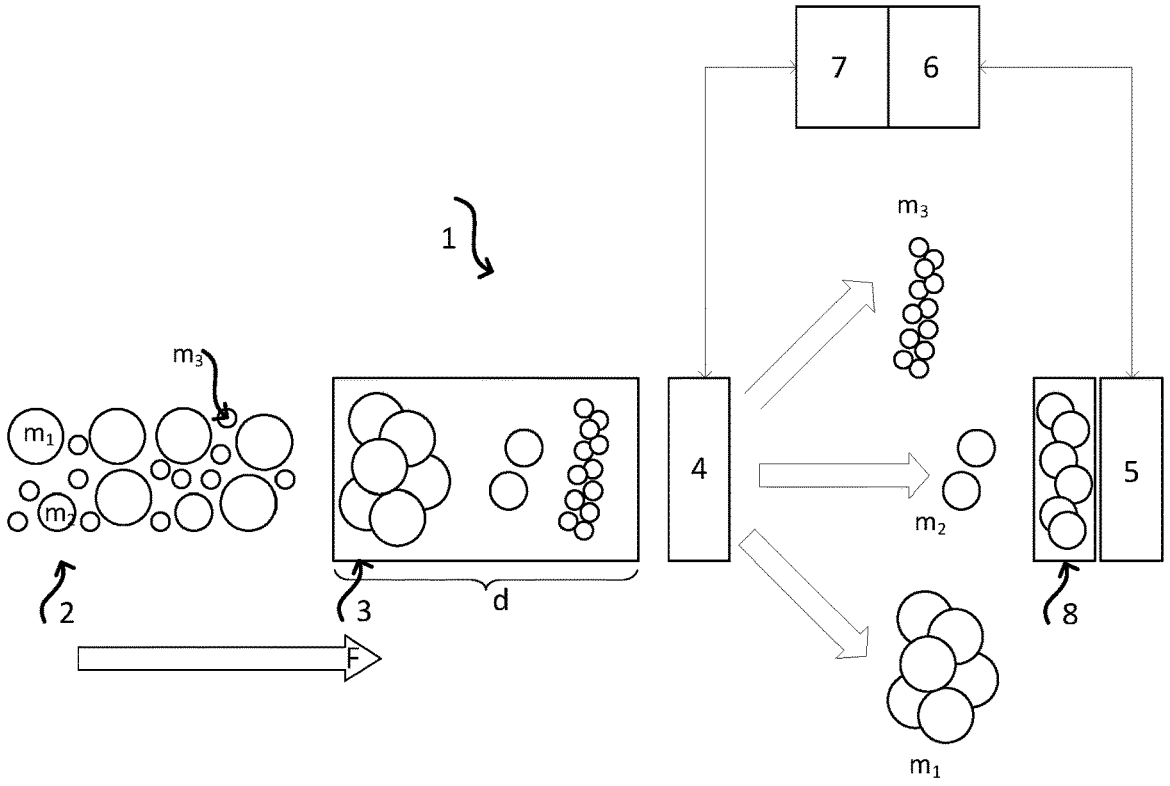
Figure 3:
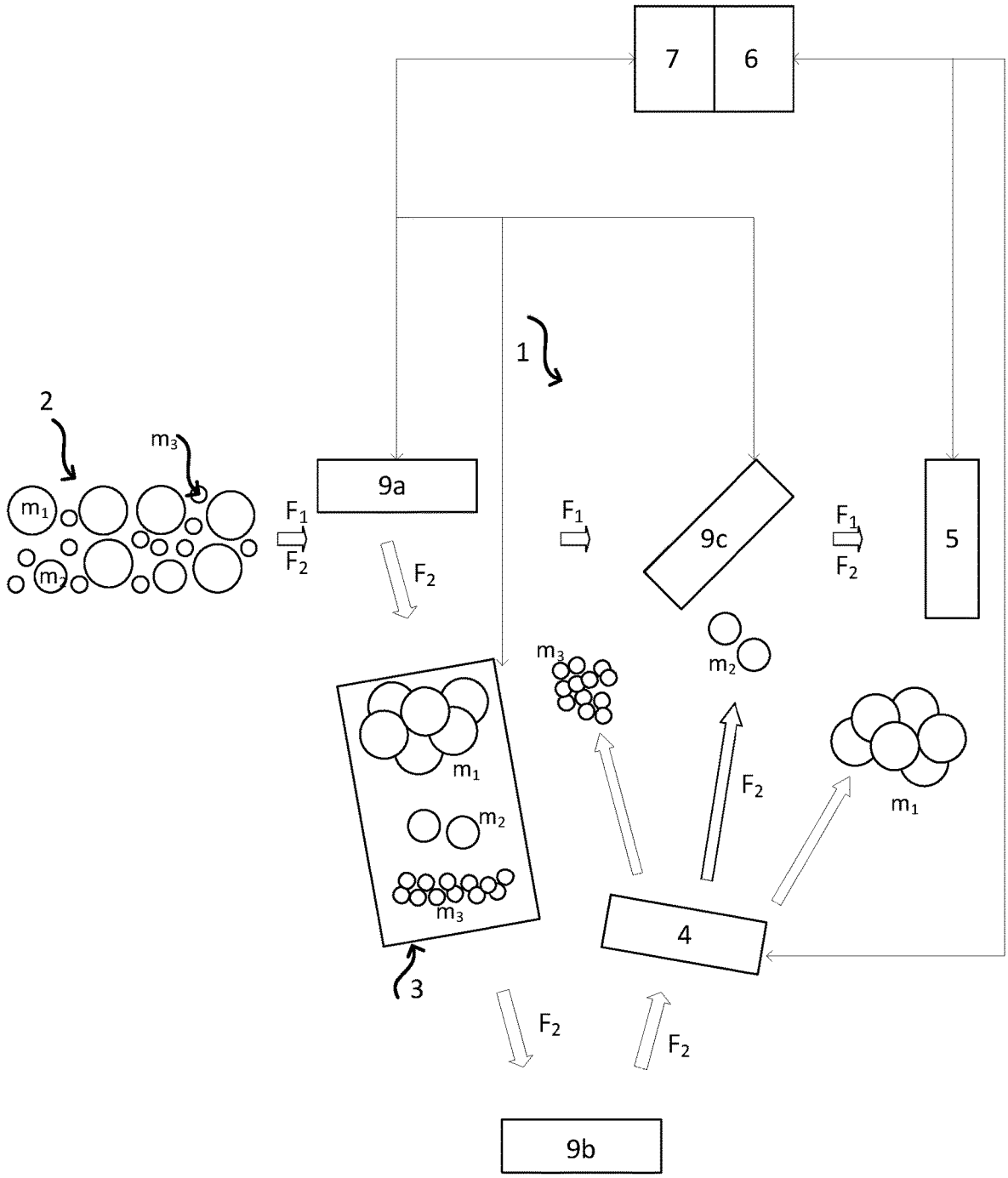
Figure 4:
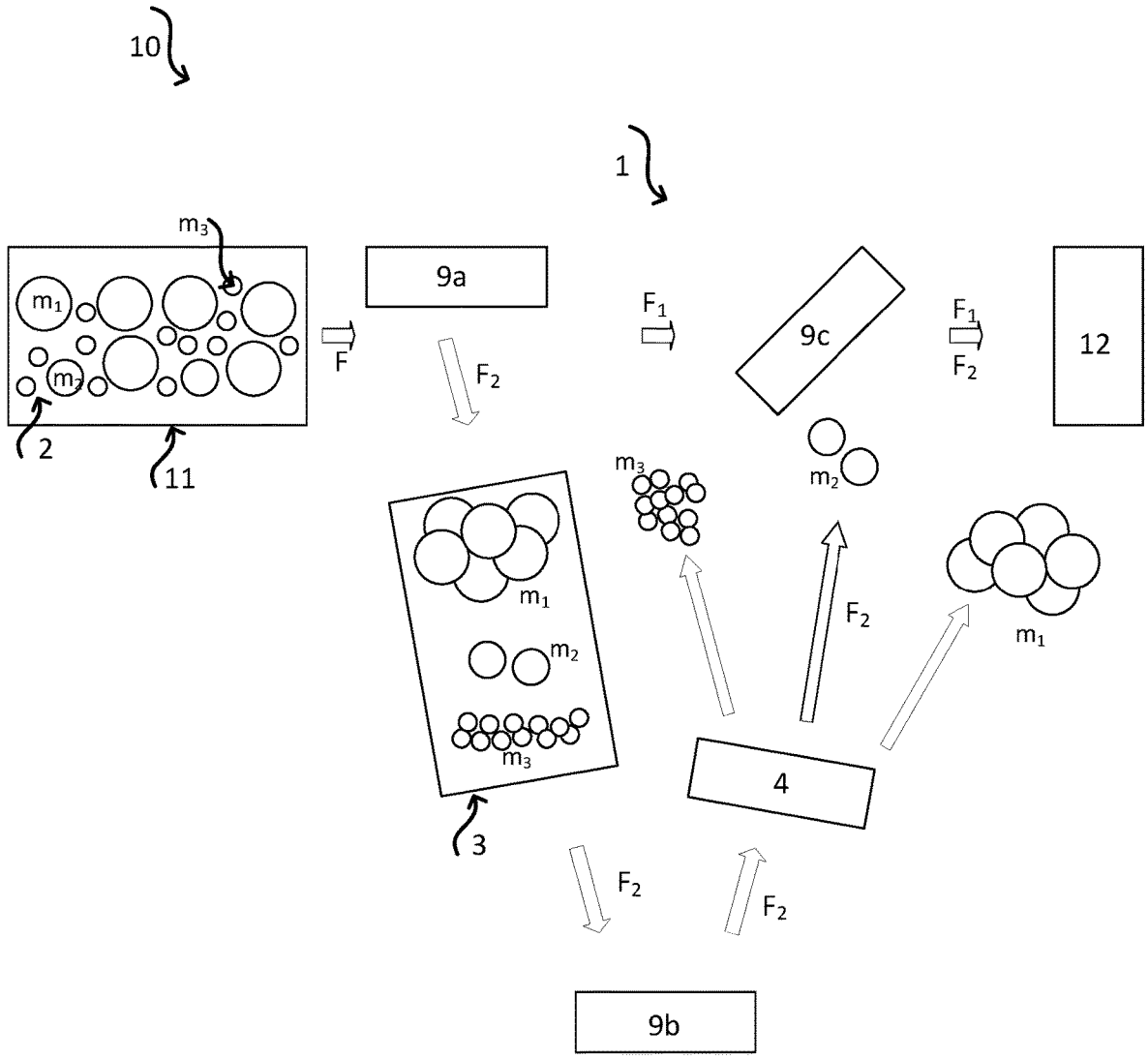
Figure 5:
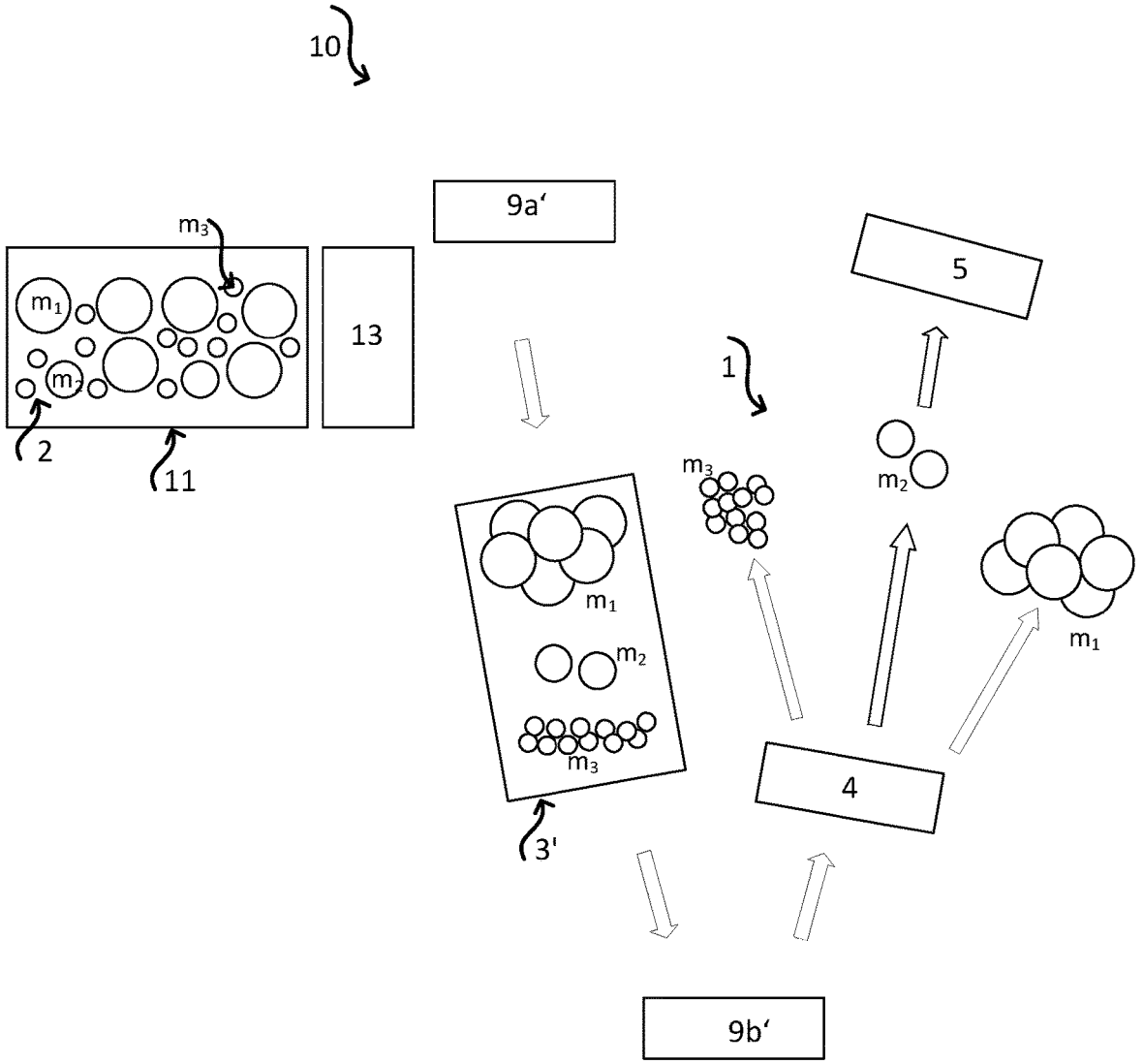

The present invention is now explained in greater detail with reference to the following figures. Identical elements in the figures are provided with the same reference signs. The following are shown:

FIG. 1 shows a first schematic embodiment of a device according to the present disclosure;

FIG. 2 shows a second embodiment of a device according to the present disclosure with an ion trap;

FIG. 3 shows a third embodiment of a device according to the present disclosure with an ion optical system;

FIG. 4 shows a first embodiment of a mass spectrometer according to the present disclosure with a device according to the present disclosure;

FIG. 5 shows an embodiment of a mass spectrometer according to the present disclosure with a device according to the present disclosure, wherein the device is an integral component of the mass spectrometer;

FIGS. 6(*a*)-6(*d*) show a mass spectrum over the entire mass range of the mass spectrometer (a) before and (b-d) after filtering selected ions from the respective ion beam.

DETAILED DESCRIPTION

FIG. 1 shows a schematic representation of a device 1 according to the invention for filtering selected ions (here on the basis of selected masses: $m_1$ and $m_3$) from an ion beam 2. The ion beam can be generated using any ionization method known from the prior art. The unit 3 is based on the principle of time-of-flight (TOF) measurement. The ions of the ion beam 2 are separated along their flight path F on the flight path of predefinable length d with regard to their masses $m_1$-$m_3$ or mass-to-charge ratios. Accordingly, the different ions $m_1$-$m_3$ impinge at different points in time on the ion optical system 4, which is arranged at the end of the flight path d. In order to travel the flight path d, the ions $m_1$-$m_3$ thus need different flight times $t_1$-$t_3$.

The ion optical system 4 serves to deflect the selected ions $m_1$ and $m_3$ from the flight path F of the ion beam 2. For this purpose, the device 1 is designed to control the ion optical system 4 subject to a flight time $t_1$ and $t_3$ of the selected ions $m_1$ and $m_3$ along the flight path d.

The non-deflected ions $m_2$ of the ion beam 2 (for the simplified example shown here, it is only the ion $m_2$; usually, a multiplicity of different ions $m_x$-$m_y$ is not deflected from the flight path F) ultimately impinge on the detector 5, which is also any detector known from the prior art. For the embodiment according to FIG. 5, the detector unit 5 is part of the device 1. However, a separate detector unit 5 is by no means absolutely necessary for the device 1 according to the invention. Rather, an existing detector unit of a mass spectrometer can also be used.

In the example shown here, the device 1 furthermore comprises a in a computing unit 6 and a control unit 7, which are arranged together here by way of example. Within the scope of the present inventions, a wide variety of possibilities are also conceivable in this respect, and the invention is by no means limited to the variant shown here. Rather, numerous other variants are conceivable, all of which fall within the present invention. For example, the computing unit 6 may also be part of the detector unit 5.

By means of the computing unit 6, the flight times $t_1$-$t_3$, masses $m_1$-$m_3$, charges, mass-to-charge ratios and/or intensities of the ions contained in the ion beam 2 can be determined. The control unit 7 then serves to control the ion optical system 4 subject to a flight time $t_1$ and $t_3$ of the selected ions $m_1$ and $m_3$ along the flight path d. In the present case, the ion optical system 4 is, for example, switched on at times $t_1$ and $t_3$ respectively, in order to deflect the selected ions $m_1$ and $m_3$ from the flight path F. For example, for the purpose of deflecting the selected ions $m_1$ and $m_3$, the ion optical system comprises a Bradbury-Nielson gate.

According to the invention, at least one ion $m_1$ or $m_3$ is filtered in each case; apart from individual selected ions $m_1$ and $m_3$, it is also possible to deflect selected ranges with selected ions as a whole from the flight path F. The ranges are, for example, selected ranges for the masses, charges, mass-to-charge ratios and/or intensities for the respectively selected ions. All ions whose masses, charges, mass-to-charge ratios and/or intensities are in the respective selected range are then filtered.

The present invention is also not limited to determining the selected ions $m_1$ and $m_3$ on the basis of a spectrum recorded by the detector 5. The selected ions $m_1$ and $m_3$ can also be selected, for example, on the basis of specified lists. In this respect, numerous other possibilities are also conceivable, all of which fall within the present invention.

FIG. 2 shows another embodiment of a device 1 according to the invention. In addition to the embodiment according to FIG. 1, the device 1 according to FIG. 2 comprises an ion trap 8, which is arranged between the ion optical system 4 and the detector unit 5. The elements explained in conjunction with FIG. 1 are therefore not discussed again here.

In the ion trap 8, the predefinable ion $m_2$ is accumulated or depleted before it impinges on the detector 5. Instead of the individual ion $m_2$ shown here, a plurality of predefinable ions or ions of at least one predefinable range can also be accumulated or depleted.

FIG. 3 shows a third embodiment of a device 1 according to the invention. In contrast to the embodiment according to FIG. 1, the device 1 according to FIG. 3 comprises an ion optical system 9. In connection with FIG. 3, elements already explained are also not discussed again.

Like the ion optical system 4, the ion optical system 9 is controllable. In the present case, by suitable adjustment of at least individual components, here by way of example 9*a* and 9*c*, it can be achieved that the entire ion beam 2 runs along the flight path F1 and is detected in its entirety by the detector unit 5. At at least one point in time, by another suitable adjustment of at least individual components, here by way of example also 9*a* and 9*c*, it can be achieved that the ion beam 2 runs along the flight path F2, wherein the selected ions m1 and m3 are deflected from their flight path F2 before the remaining ion beam 2 reaches the detector unit 5.

The ion optical system 9 outlined here comprises a so-called ion pusher 9*a*, a reflector 9*b* and an ion mirror 9*c*. In addition to the embodiment shown here, numerous further embodiments of the ion optical system 9 are possible, which have other components, a different number of components and/or other arrangements of the components, and which all likewise fall within the present invention.

For the embodiment shown, the ion optical system 9 is also controlled by means of the control unit 7. However, it goes without saying that the ion optical system 9 in other embodiments can also be suitably controlled in a different manner.

By using an ion optical system 9, it is advantageously possible by means of the device 1 to carry out both scans over the entire available mass range and scans over predefinable subranges or over the entire available range minus the selected ions $m_1$ and $m_3$.

FIG. 4 shows a mass spectrometer 10 according to the invention with a device 1 similar to the embodiment of the device 1 according to FIG. 3. The mass spectrometer 10 can be any mass spectrometer according to the prior art. The mass spectrometer comprises an ionization unit 11, by means of which the ion beam 2 is generated, an analyzer and a detector, both of which are combined with further components of the mass spectrometer 10 by reference sign 12. A device 1 according to the invention is arranged between the ionization unit 11 and the remaining components of the mass spectrometer 10 combined by reference sign 12. In the embodiment shown, the device 1 does not have its own detector unit 5, but uses an existing detector unit of the mass spectrometer 10. The same applies to the computing unit 6 and the control unit 7. The latter are also components of the mass spectrometer 10 and are combined by reference sign 12. The control of the ion optical system 4 and of the remaining components of the device 1 takes place analogously to the embodiments shown in the preceding figures. It should be noted that naturally, in other embodiments, a separate detector unit 5, computing unit 6 and/or control unit 7 for the device 1 may also be present.

In the case of a mass spectrometer 10 according to the invention, the device 1 can be formed on the one hand as a self-contained unit, which can be integrated into the existing mass spectrometer 10 as in the case of FIG. 4. However, it may also be an integral component of the mass spectrometer 10 as in the case of the exemplary embodiment shown in FIG. 5. The embodiment shown in FIG. 5 is a TOF mass spectrometer. In the case of such a mass spectrometer 10, a device 1 according to the invention can be integrated in a particularly simple manner.

As in the case of FIG. 4, the mass spectrometer comprises an ionization unit 11. Furthermore, an optical focusing unit 13 is optionally present. The mass spectrometer 10 shown furthermore has an ion optical system 9*a*', 9*b*', and a unit 3' for creating an electric field for accelerating the ions along a flight path of predefinable length d. Such components essentially correspond to the components of the preceding figures provided with the same reference signs without apostrophes. In the present case, however, such components are part of the existing mass spectrometer 10. In contrast, the device 1 does not have corresponding separate components. The detector unit 5 and the ion optical system 4 are in contrast components of the device 1 according to the invention. For the sake of simplicity, the drawing of a computing unit 6 and a control unit 7 has been dispensed with for this figure. They can be implemented, for example, in accordance with one of the previously described embodiments. Optionally, the device 1 or the mass spectrometer 10 can have further components already discussed in connection with previous figures. For example, the ion optical system 9 may comprise an ion mirror 9*c* or else further units for directing and/or focusing the ion beam, or an ion trap 8 may additionally be present.

A schematic illustration of the method according to the invention is lastly shown in FIG. 6. FIG. 6*a* shows a complete mass spectrum over the available range of mass-to-charge ratios I(m/z). The ion beam 2 contains various ions $m_1$-$m_6$, of which only the ions $m_1$-$m_4$ can be seen in the spectrum due to the low concentrations of some of the ions. The concentrations, and thus the intensities of the ions $m_5$ and $m_6$, are so low that they are below the sensitivity limit $d_L$ of the mass spectrometer 10. However, the ion $m_4$ is also difficult to detect since it is only slightly above the sensitivity limit $d_L$ of the mass spectrometer 10.

In order to be able to also detect the low-concentration substances, the ions $m_1$ and $m_3$ are selectively filtered in a first step or filtering process according to the method according to the invention in accordance with one of the described embodiments. For this purpose, the ions $m_1$ and $m_3$ are selectively deflected by the ion optical system 4 at times $t_1$ and $t_3$, at which they respectively impinge on the ion optical system 4. The filter pattern used thus comprises two filter windows $F_1$ and $F_2$.

Figure 6A:
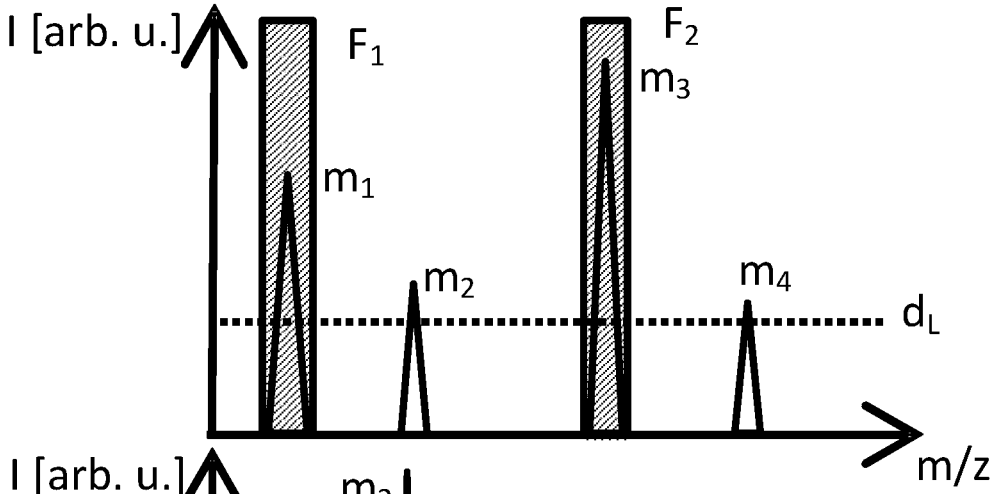
Figure 6B:
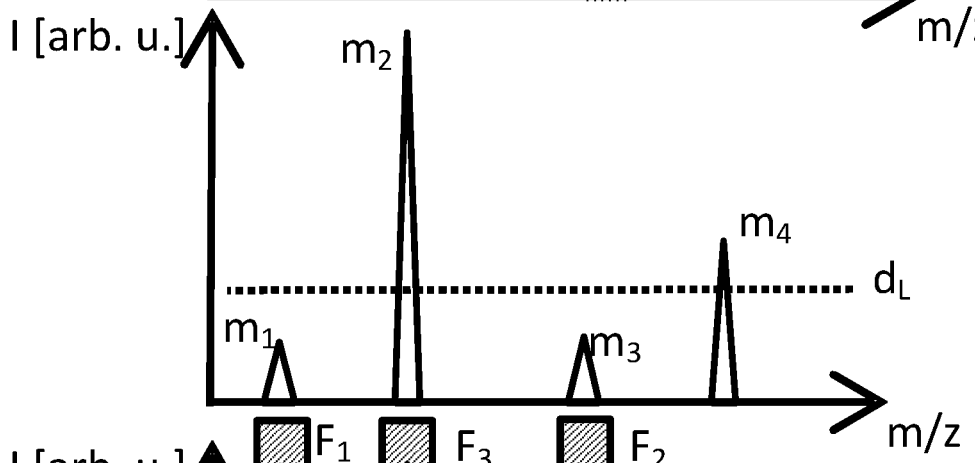

The result of this filtering is shown in FIG. 6*b*. The concentrations of the ions $m_1$ and $m_3$ are significantly reduced and are now ideally below the original sensitivity limit $d_L$. On the other hand, the ions $m_2$ and $m_4$ are now both clearly detectable as a result of the shift of the dynamic sensitivity range downward.

Figure 6C:
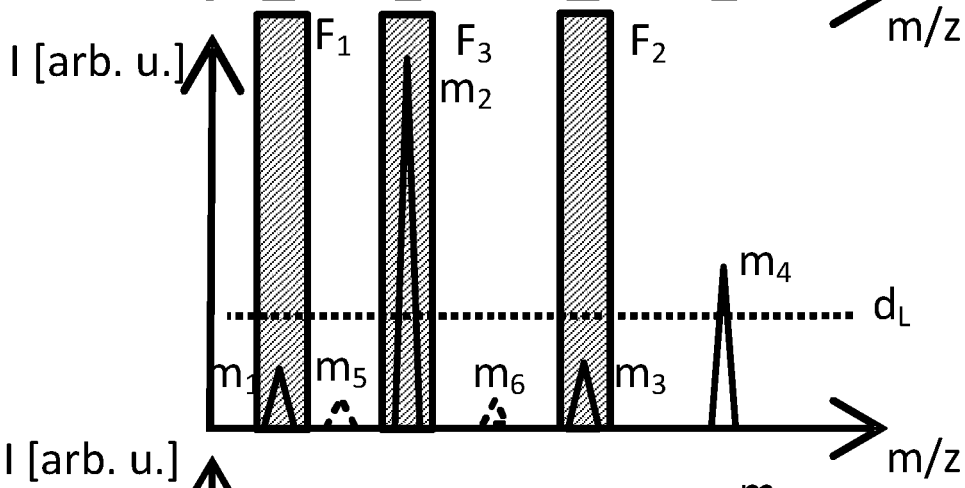
Figure 6D:
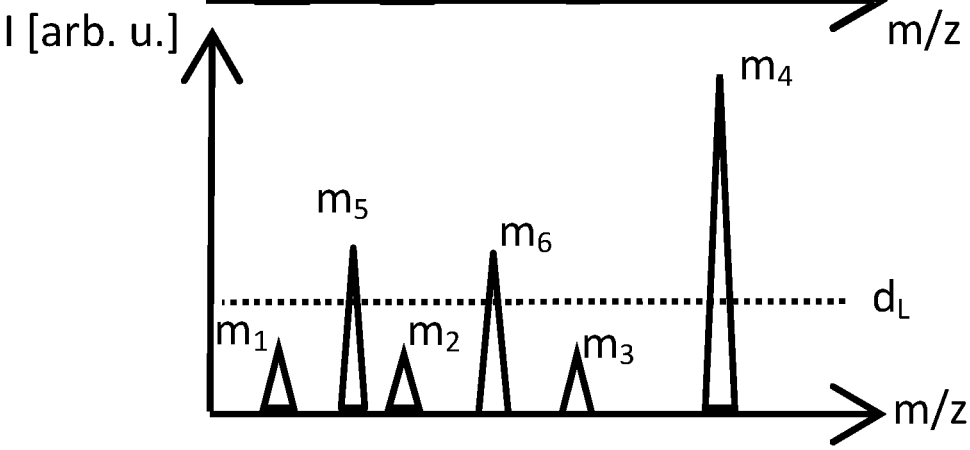

In order to be able to detect the detectability of even less concentrated ions, such as the ions $m_5$ and $m_6$, which are shown as dashed lines in FIG. 6*c*, a further filtering process with respect to the second ion $m_2$ can be carried out by means of the additional filter window $F_3$, as FIG. 6*c* illustrates. In addition to the ions $m_1$ and $m_3$, the ion $m_2$ is thus selectively filtered. The result of such further filtering is the subject matter of FIG. 6*d*. The previously undetectable ions $m_5$, $m_2$ and $m_6$ can now be clearly detected. Depending on the application, suitable filter patterns can be designed by means of the method according to the invention, which selectively filter predefinable ions $m_x$ or predefinable ranges, for example mass ranges Δm, from the ion beam 2 in one or more subsequent filtering processes.

The invention claimed is:

1. A device for filtering at least one selected ion from an ion beam, the device comprising:

a unit configured to generate an electric field capable of accelerating ions of the ion beam along a flight path of predefinable length;

an ion optical system configured to be controllable in a time-dependent manner, to delimit the flight path in one direction at an end portion of the flight path, and to deflect the at least one selected ion from the flight path of the ion beam;

an ion trap configured to accumulate or deplete at least one predefined ion within at least one predefinable range, which range comprises non-deflected ions of the ion beam, wherein the ion trap is disposed between the ion optical system and a detector configured to record mass spectra; and a controller configured to control the ion optical system based on a flight time of the at least one selected ion along the flight path, wherein the ion optical system is configured to be switched on during at least one time interval in which the at least one selected ion passes through the ion optical system as to deflect the at least one selected ion from the flight path, wherein the at least one selected ion has an intensity or number exceeding a predefinable limit value.

2. The device of claim 1, further comprising the detector, which is configured to detect and/or determine the masses, charges, mass-to-charge ratios and/or intensities of the ions comprising the filtered ion beam.

3. The device of claim 1, further comprising a computing unit configured to determine the flight times, masses, charges, mass-to-charge ratios and/or intensities of the ions comprising the ion beam.

4. The device of claim 1, further comprising a control unit configured to control the ion optical system based on a flight time of the at least one selected ion along the flight path.

5. The device of claim 1, wherein the ion optical system comprises at least one Bradbury-Nielson gate.

6. The device of claim 1, wherein the ion trap is an orbitrap or a C-trap.

7. The device of claim 1, further comprising a second ion optical system configured to direct the ion beam at least at a predefinable point in time such that the ion beam passes through the device.

8. A mass spectrometer comprising the device of claim 1.

9. A method for filtering at least one selected ion from an ion beam, the method comprising:

accelerating ions comprising the ion beam along a flight path of predefinable length using a unit configured to generate an electric field capable of accelerating the ions;

deflecting the at least one selected ion from the flight path of the ion beam based on a flight time of the at least one selected ion along the flight path using an ion optical system;

controlling the ion optical system to be switched on during at least one time interval in which the at least one selected ion passes through the ion optical system as to deflect the at least one selected ion from the flight path, wherein the at least one selected ion has an intensity or number exceeding a predefinable limit value; and accumulating or depleting at least one predefined ion within at least one predefinable range, which range comprises non-deflected ions of the ion beam using an ion trap disposed between the ion optical system and a detector configured to record mass spectra.

10. The method of claim 9, wherein the at least one selected ion is selected based on at least one mass spectrum of the ion beam and/or based on the masses, charges, mass-to-charge ratios and/or intensities of the ions comprising the ion beam.

11. The method of claim 9, wherein an accumulation factor or a depletion factor is determined.

12. The method of claim 11, wherein the at least one predefined ion within the predefinable range is accumulated or depleted with a predefinable accumulation factor or a predefinable depletion factor, respectively.

* * * * *